United States Patent [19]

Niinomi et al.

[11] 4,391,176

[45] Jul. 5, 1983

[54] ELECTRONIC MUSICAL INSTRUMENT WITH MUSICAL COMPOSITION FASHION SELECTORS

[75] Inventors: Naoyuki Niinomi; Kunihiko Watanabe, both of Hamamatsu, Japan

[73] Assignee: Nippon Gakki Seizo Kabushiki Kaisha, Tokyo, Japan

[21] Appl. No.: 182,575

[22] Filed: Aug. 29, 1980

[30] Foreign Application Priority Data

Sep. 8, 1979 [JP] Japan ..... 54-115400

[51] Int. Cl.[3] ..... G10H 1/12; G10H 1/38; G10H 1/46

[52] U.S. Cl. ..... 84/1.17; 84/1.19; 84/1.25; 84/1.26; 84/1.27; 84/DIG. 22

[58] Field of Search ..... 84/1.01, 1.11–1.13, 84/1.17, 1.19–1.27, DIG. 12, DIG. 22, DIG. 23, DIG. 25

[56] References Cited

U.S. PATENT DOCUMENTS

| | | | |
|---|---|---|---|
| 3,626,078 | 12/1971 | Sekiguchi | 84/1.24 |
| 3,697,664 | 10/1972 | Hiyama | 84/1.17 |
| 3,803,338 | 4/1974 | Adachi | 84/1.17 |
| 3,886,834 | 6/1975 | Okamoto | 84/1.17 |
| 3,897,709 | 8/1975 | Hiyoshi et al. | 84/1.19 |
| 4,129,055 | 12/1978 | Whittington et al. | 84/1.01 |
| 4,191,082 | 3/1980 | Koike | 84/1.19 |

*Primary Examiner*—S. J. Witkowski

*Attorney, Agent, or Firm*—Blakely, Sokoloff, Taylor & Zafman

[57] ABSTRACT

A plurality of sets of such characteristics as the color, volume and effect of a musical tone are preset for different musical composition fashions. Desired preset characteristics are selected independently in the melody performance portion and the accompaniment performance portion by operating a corresponding melody musical composition fashion selection switch and a corresponding accompaniment musical fashion selection switch thus establishing a musical tone having a desired musical composition fashion for each portion. According to a modified embodiment, when either one of the melody and accompaniment musical composition fashion selection switches is operated, both the musical composition fashions of the melody performance portion and the accompaniment portion are established in predetermined manner.

18 Claims, 7 Drawing Figures

ELECTRONIC MUSICAL INSTRUMENT WITH MUSICAL COMPOSITION FASHION SELECTORS

BACKGROUND OF THE INVENTION

This invention relates to an electronic musical instrument, and more particularly an electronic musical instrument with musical composition fashion selectors.

In a prior art electronic organ, a desired musical tone is established by suitably setting a plurality of tone levers which are provided for each of a upper keyboard (UK), a lower keyboard (LK) and a pedal keyboard (PK) and by setting variable resistors (volumes) or switches regarding such effects as a vibrato, tremolo, etc., as well as variable resistors or switches regarding UK/LK tone volume balance, an attack time, a sustain time, etc. However, for a not yet skilled performer, it is difficult to independently set a plurality of operating members for a melody performance portion (usually a UK portion), and an accompaniment portion (usually an LK portion and a PK portion) according to such musical composition fashions as an organ fashion, a piano fashion, etc., so that it takes a considerable time to establish the desired musical tone before beginning a performance.

SUMMARY OF THE INVENTION

Accordingly, it is an object of this invention to provide an improved electronic musical instrument capable of establishing a musical tone to be commensurate with a desired musical component fashion by simple operation.

The electronic musical instrument of this invention is characterized in that a plurality of sets of such characteristics as the color, volume and effect of a musical tone is preset in the melody performance portion and the accompaniment performance portion each of musical component fashions and desired preset characteristics in the melody performance portion and the accompaniment performance portion are independently selected by operating a corresponding melody musical composition fashion selection switch and an accompaniment musical component fashion selection switch so as to readily be able to establish a musical tone having a desired musical composition fashion. Moreover, for the purpose of making such characteristics more effective when either one of the melody musical component fashion selection switch and the accompaniment musical component fashion selection switch is not used, the operation of the other switch is arranged to designate the musical component fashion of both of the melody performance portion and the accompaniment performance portion.

According to this invention, there is provided an electronic musical instrument comprising a first keyboard having a plurality of keys for performing a melody; a second keyboard having a plurality of keys for performing an accompaniment; a melody tone generator generating a melody tone in response to depression of a key of the melody performance keyboard; an accompaniment tone generator generating an accompaniment tone in response to depression of a key of the performance keyboard; a melody musical composition fashion selection switch designating a musical fashion of a musical tone for a melody to be produced from among a predetermined kinds of musical composition fashion to be performed; an accompaniment musical composition fashion selection switch designating a musical composition fashion of a musical tone for an accompaniment to be produced from among predetermined kinds of musical composition fashion; a modifying parameter generator which generates different modifying parameters corresponding to an operated one of the musical composition fashion selection switches; modifying means for changing outputs of the melody and accompaniment tone generators in accordance with an output of the modifying parameter generator; and means for producing a musical tone signal in accordance with an output of the modifying means.

DESCRIPTION OF THE PREFERRED EMBODIMENT

Figure 1:
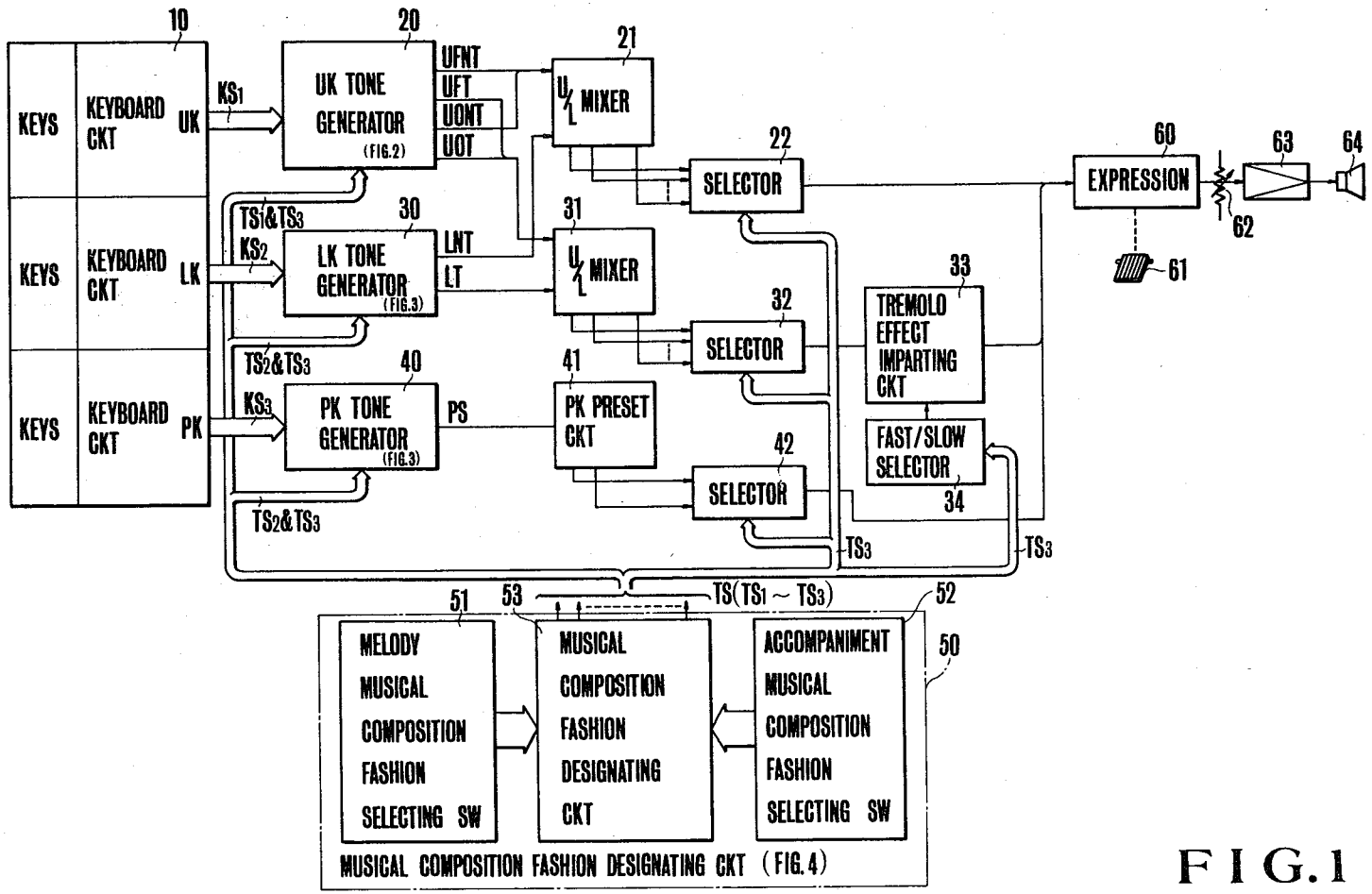
FIG. 1 is a block diagram showing the circuit construction of one embodiment of the electronic musical instrument according to this invention.
Figure 2:
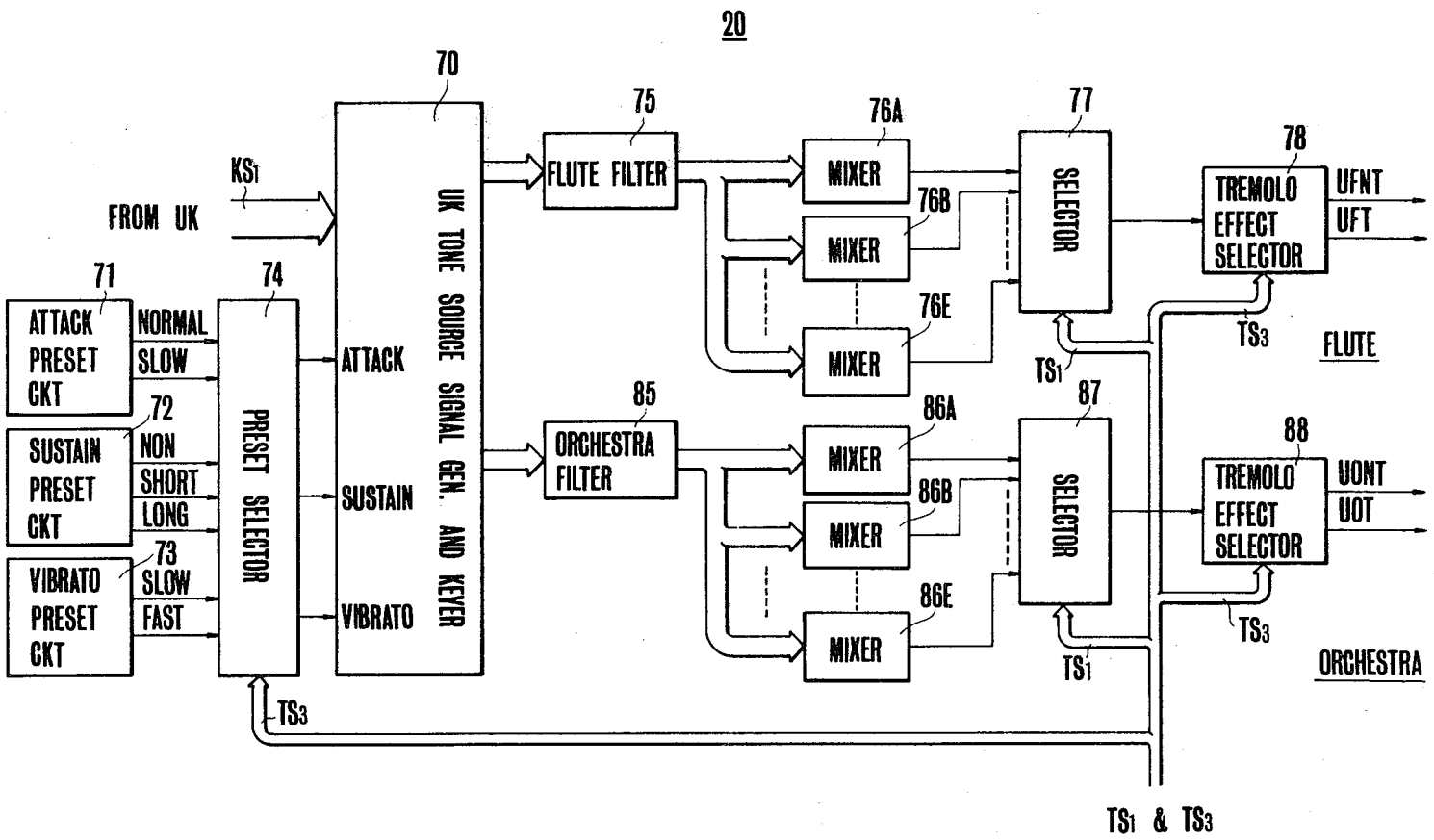
FIG. 2 is a block diagram showing the detail of the UK tone generator of the circuit shown in FIG. 1.
Figure 3:
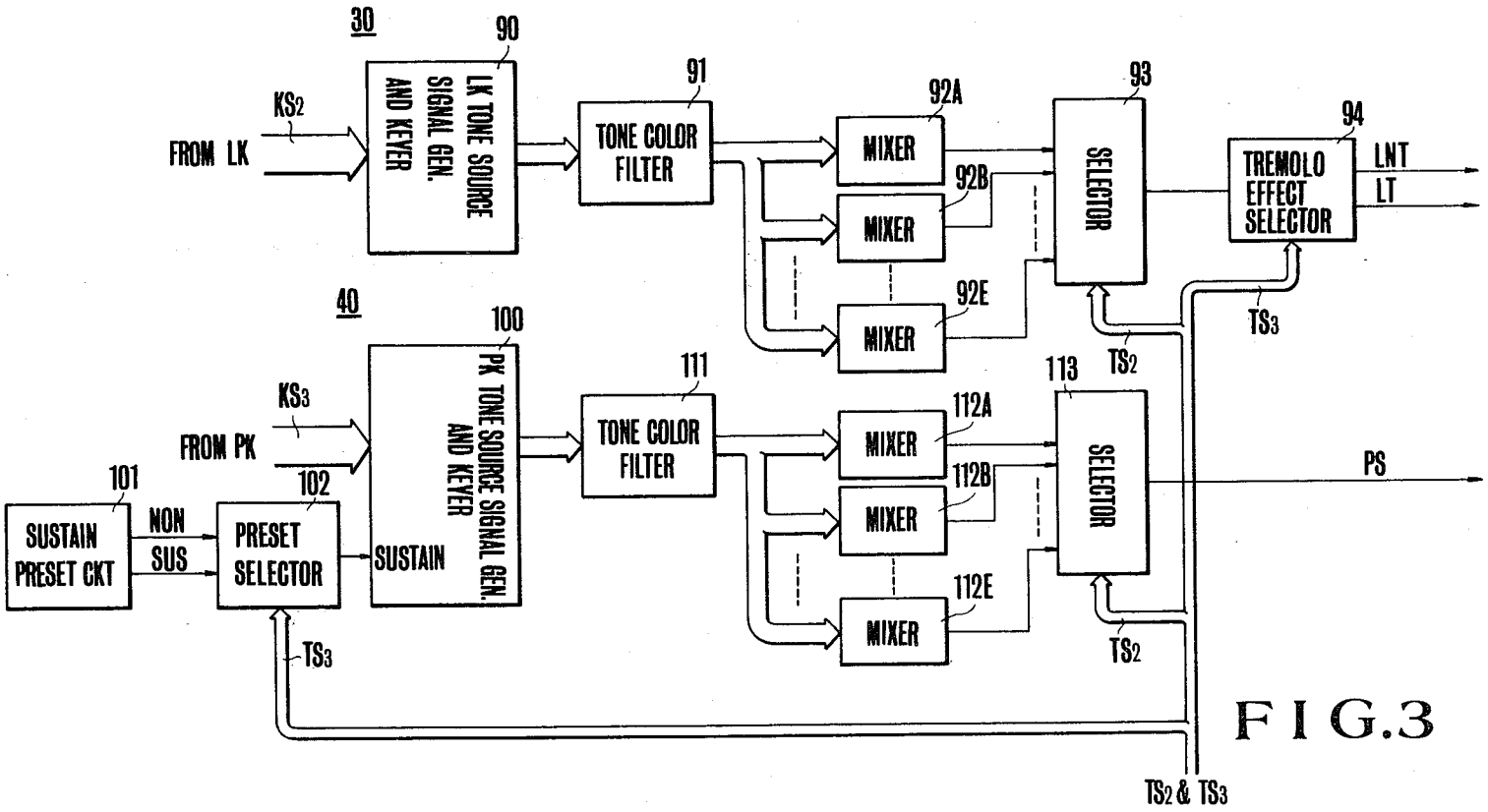
FIG. 3 is a block diagram showing the detail of the LK tone generator and the PK tone generator of the circuit shown in FIG. 1.
Figure 4:
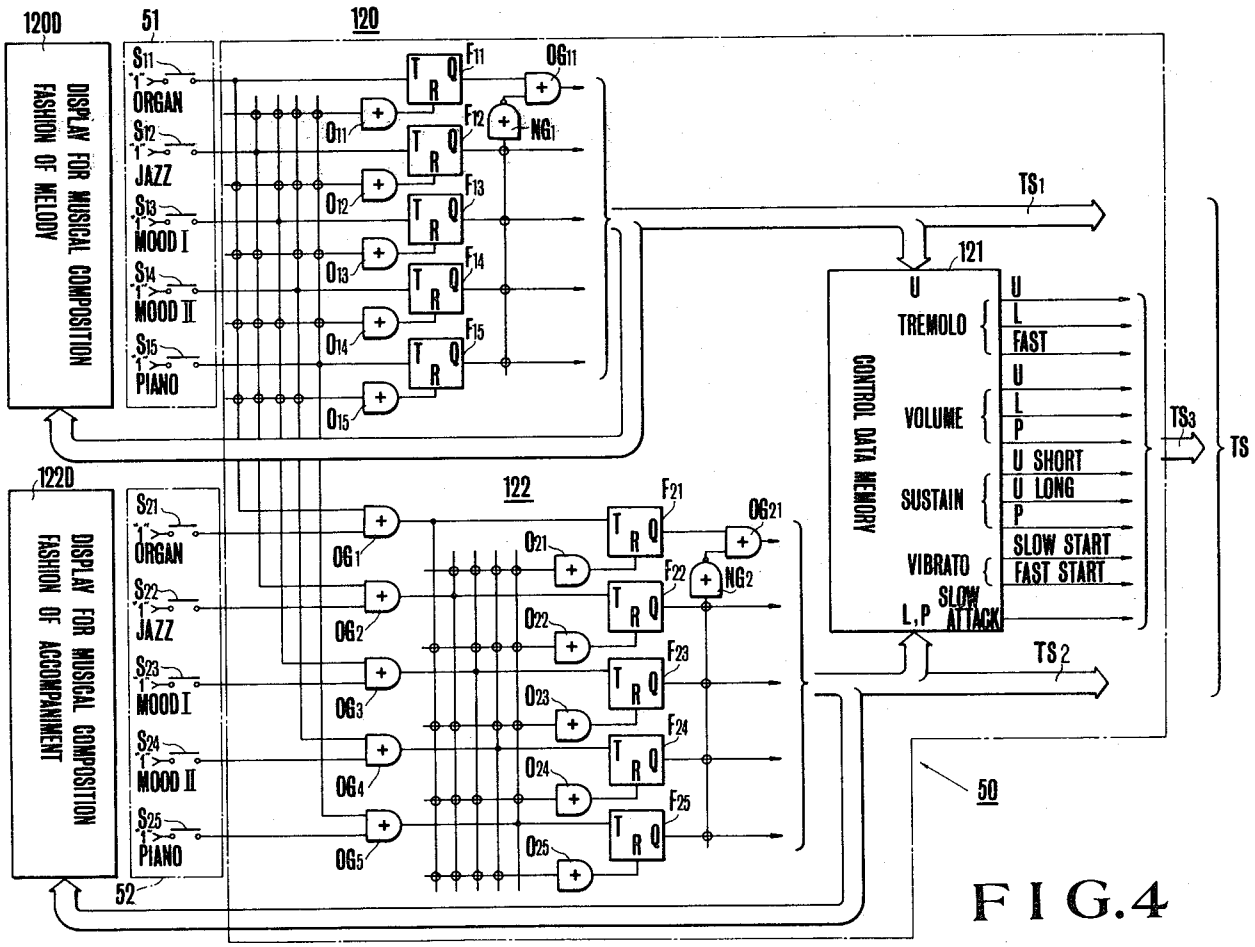
FIG. 4 is a connection diagram showing the detail of the musical composition fashion designating circuit shown in FIG. 1 and FIGS. 5, 5A and 6 are connection diagrams showing modifications of the musical composition fashion selection switch circuit.

A preferred embodiment of the electronic musical instrument shown in FIG. 1 comprises a keyboard circuit 10 producing a first key state signal $KS_1$ showing that which one of the keys of the upper keyboard UK has been depressed, a second key state signal $KS_2$ showing that which one of the keys of the lower keyboard LK has been depressed, and a third key state signal $KS_3$ showing that which one of the keys of the pedal keyboard PK has been depressed; a UK tone generator 20 (the detail thereof will be described later with reference to FIG. 2) which in response to the first key state signal $KS_1$ generates a flute type non-tremolo musical tone signal UFNT, a flute type tremolo musical tone signal UFT, an orchestra type nontremolo musical tone signal UONT and an orchestra type tremolo musical tone signal; an LK tone generator 30 (the detail thereof will be described later with reference to FIG. 3) which in response to the second key state signal $KS_2$ generates a nontremolo musical tone signal LNT and a tremolo musical tone signal LT; a PK tone generator 40 which in response to the third key state signal $KS_3$ produces a musical tone signal PS (the detail of this generator will be described later with reference to FIG. 3); and a musical composition fashion designating circuit 50 (the detail thereof will be described later with reference to FIG. 4) which generates a musical composition fashion designating signal TS under the control of a musical composition fashion designating circuit 53 when melody musical component fashion selection switch 51 and an accompaniment musical composition fashion selection switch 52 are operated both of them being self-returning type switches.

The musical composition fashion designating signal TS includes signals $TS_1$ and $TS_2$ respectively designating a tone color based on harmonic overtone components for a melody performance portion and an accompaniment performance portion, and a signal $TS_3$ designating such transient characterstics as an attack and a sustain, as well as such various characteristics as a tremolo effect, a vibrato effect, a brilliance effect and a tone volume effect. The signal $TS_1$ and a portion of the signal $TS_3$ (regarding the attack, sustain, vibrato and tremolo) are supplied to the UK tone generator 20, while the signal $TS_2$ and a portion of the signal $TS_3$ (regarding the sustain and tremolo) are applied to the LK tone generator 30 and the PK tone generator 40.

Each of the flute type nontremolo musical tone signal UFNT and the orchestra type nontremolo musical tone signal generated by the UK tone generator 20 are not intended to be imparted with a tremolo effect. Also the nontremolo effect musical tone signal LNT generated by the LK tone generator 30 is not intended to be imparted with the tremolo effect. The nontremolo musical tone signals UFNT and UONT on the UK side are mixed together and then applied to one input of a U/L mixer (or U/L tone volume preset circuit) 21, while the nontremolo musical tone signal LNT on the LK side is applied to the other input of the U/L mixer 21. For example, the U/L mixer comprises a plurality of potentiometers with their movable contacts from which outputs are derived out and which are positioned at predetermined positions, the potentiometers being connected in parallel across a pair of input terminals so as to admix the mixture of the musical tone signals UFNT and UONT, and the musical tone signal LNT at the predetermined mixing ratios and then parallelly feeds the admixed musical tone signals to a preset selector 22 which selects a musical tone signal of a specific tone volume according to a UK side tone volume designating signal out of the musical composition fashion designating signal $TS_3$.

On the other hand, each of the flute type tremolo musical tone signal UFT and the orchestra type tremolo musical tone signal sent out from the UK tone generator 20 are intended to be imparted with the tremolo effect, and the tremolo musical tone signal LT sent out from the LK tone generator 30 is also intended to be imparted with the tremolo effect. The tremolo musical tone signals UFT and UOT on the Uk side are mixed together and then applied to one input of a U/L mixer (U/L tone volume balance preset circuit) 31, the other input thereof being supplied with the tremolo musical tone signal on the LK side. The U/L mixer 31 has a construction similar to the U/L mixer 21 and operates in the same manner so that a musical tone produced by admixing, at various ratios according to the preset positions of the movable contacts of the potentiometers, a mixture of the musical signals UFT and UOT, and the musical tone signal LT is parallelly derived from the output terminal of the U/L mixer 31. These parallelly outputted musical tone signals are applied to a selector 32 similar to selector 22 to select a musical tone signal having a specific tone volume in accordance with the LK side tone volume designating signal out of the musical composition fashion designating signal $TS_3$.

The musical tone signal sent out from the selector 32 is applied to a tremolo effect imparting circuit 33 in which the musical tone signal is subjected to an amplitude modulation by a tremolo modulation low frequency signal to be imparted with the tremolo effect. The tremolo modulation speed in the tremolo effect imparting circuit 33 is controlled by a control signal from a fast/slow selector 34 which acts to supply a fast or slow control signal to the tremolo effect imparting circuit 33 in accordance with a tremolo speed designating signal of the musical composition fashion designating signal $TS_3$.

The musical tone signal PS produced by the PK tone generator 40 is applied to a PK preset circuit 41 where it is converted into a plurality of musical tone signals having different tone volumes according to the preset content of the potentiometers. These plurality of musical tone signals produced by the PK preset circuit 41 are sent to a selector 42 where a musical tone signal having a specific tone volume is selected according to a PK tone volume designating signal of the musical composition fashion designating signal $TS_3$.

The musical tone signals are respectively generated by the selector 22, the tremolo effect imparting circuit 33 and the selector 42 are mixed together and then applied to an expression (EXP) device 60 to control volume of them according to the depression angle of an expression pedal 61. The musical tone signal delivered from the expression device 60 is supplied to an output amplifier 63 via a master volume (potentiometer) 62 and the musical tone signal amplified by the amplifier 63 is converted into a musical tone by a loudspeaker 64.

The detail of the UK tone generator 20 mainly used for a melody performance will now be described with reference to FIG. 2. A UK tone source signal generator and keyer 70 supplied with the key state signal $KS_1$ from the upper keyboard UK comprises a tone source unit generating a tone source signal having a frequency corresponding to each key of the upper keyboard, a switching unit for opening and closing the tone source signal from the tone source unit in accordance with the key state signal $KS_1$, and a vibrato effect imparting circuit which frequency-modulates the tone source signal with the vibrato modulation low frequency signal. This construction is disclosed, for example, in U.S. Pat. No. 4,191,082 dated Mar. 4, 1980. The UK tone source signal generator and keyer 70 is constructed such that the attack time and the sustain time of the opening and closing envelope of the switch unit and the vibrato start speed of the vibrato effect circuit are set according to corresponding control signals. To enable such control, there are provided an attack preset circuit 71, a sustain preset circuit 72, a vibrator preset circuit 73 and a preset selector 74. More particularly, the attack circuit 71 applies a control signal corresponding to a normal preset attack time and a slow attack time longer than the normal attack time to the preset selector 74 while the sustain preset circuit 72 applies to the preset selector 74 a control signal corresponding to a nonsustain time, a short sustain time and a long sustain time. The vibrato preset circuit 73 supplies to the preset selector 74 a control signal corresponding to slow start and fast start, whereas the preset selector 74 selects a control signal designated by a designating signal relating to the attack time, the sustain time and the vibrato start time of the musical composition fashion designating signal $TS_3$ among control signals supplied from respective preset circuits 71 through 73 and applies the selected control signal to the UK tone source signal generator and keyer 70 to set the attack time, the sustain time and the vibrato start speed.

The output signals of the UK tone source signal generator and keyer 70 are applied to a flute filter 75 according to feed rates, whereby the flute filter 75 forms tone color signals corresponding to the tone colors of attack 4 feet (AT4'), flute 16 feet (FL16'), flute 8 feet (FL8'), flute 4 feet (FL4'), flute $2\frac{2}{3}$ feet (FL$2\frac{2}{3}$) and flute 2 feet (FL2'). The musical tone signals produced by the flute filter 75 are parallelly applied to five mixers 76A, 76B . . . 76E provided to correspond respectively to five musical composition fashions of an organ fashion, a jazz fashion, a mood I fashion, a mood II fashion and a piano fashion, for example. Each of the mixers 76A through 76E is constituted by tone volumes (variable resistors) provided for respective tone colors, and a mixer for mixing together the musical tone signals through these volumes. Accordingly, by presetting the resistance values of respective volumes it is possible to preset tone colors corresponding to respective musical composition fashions. The musical tone signals produced by respective mixers 76A through 76E are applied to a selector 77 where a musical tone signal is selected, having a tone color corresponding to a specific musical composition fashion designated by the musical composition designating signal $TS_1$. A flute type musical tone signal sent out from the selector 77 is sent to a tremolo effect selector 78 which sends out the input musical tone signal as a flute type nontremolo musical tone signal UFNT or a flute type tremolo musical tone signal UFT depending upon whether the musical composition fashion designating signal $TS_3$ designates the application of the tremolo effect or not.

The signals outputted from the UK tone source signal generator and keyer 70 are also supplied to an orchestra filter 85 according to feet rates to from tone color by filters corresponding to respective tones of trombone 16 feet (TB16'), trumpet 8 feet (TP8'), oboe 8 feet (OB8'), clarinet 8 feet (CL8') and strings 8 feet (ST8'). The musical tone signals derived from the orchestra filter 85 are parallelly applied to five mixers 86A through 86E corresponding to the five musical composition fashions described above to set tone colors corresponding to respective musical composition fashions in the same manner as in the mixers 76A through 76E. The musical tone signals from the mixers 86A through 86E are applied to a selector 87 similar to the aforementioned selector 77 so as to select a musical tone of a tone color corresponding to a special musical composition fashion designated by the musical composition fashion designating signal $TS_1$. An orchestra type musical tone signal sent out from the selector 87 is sent to a tremolo effect selector 88 which sends out the input musical tone signal as an orchestra type nontremolo musical tone signal UONT or an orchestra type tremolo musical tone signal UOT depending upon whether the musical composition fashion designating signal $TS_3$ designates the addition of the tremolo effect or not.

Referring now to FIG. 3, the detail of the LK tone generator 30 mainly utilized for a chord performance and a PK tone generator 40 mainly used for a base performance will now be described as follows. The Lk tone generator 30 comprise an LK tone source signal generator and keyer 90 including a tone source unit generating a tone source signal having a frequency corresponding to each key of the lower keyboard and a keyer for opening and closing the tone source signal generated by the tone source unit according to the key state signal $KS_2$ from the lower keyboard, and a tone color filter 91 which forms the tone colors such that the output of the LK tone source generator and keyer 90 will have the tone colors corresponding to a piano I, a piano II, a guitar, or a harpsichord.

In the same manner as in the UK tone generator 20, the musical tone signal generated by the tone color filter 91 is applied to a selector 93 parallelly through mixers 92A, 92B . . . 92E for respective musical composition fashions where a musical tone signal is selected having a tone color corresponding to a specific musical composition fashion designated by the musical composition fashion designating signal. The LK musical tone signal derived from the selector 93 is applied to a tremolo effect selector 94 which sends out the input musical tone signal as the nontremolo musical tone signal LNT or the tremolo musical tone signal LT depending upon whether the musical composition fashion designating signal $TS_3$ designates the addition of the tremolo effect or not.

The PK tone generator 40 comprises a PK tone source signal generator and keyer 100 including a tone source unit for producing a tone source signal having a frequency corresponding to each key of the pedal keyboard, and a keyer which opens and closes the tone source signal generated by the tone source unit in accordance with the key state signal $KS_3$ from the pedal keyboard, a sustain preset circuit 101 presetted with a signal that controls the nonsustain time and sustain time of the opening and closing envelope effected by the keyer of the PK tone source generator and keyer 100, and a preset selector 102 which selects the nonsustain and sustain control signals from the sustain preset circuit 101 according to a sustain designating signal of the musical composition designating signal $TS_3$ and applies the selected control signals to the PK tone source generator and keyer 100. In this PK tone source generator and keyer 100, where the control signal from the preset selector 102 designates the nonsustain of the opened and closed envelope to immediately attenuate as a key is released, whereas when the control signal from the preset selector 102 designates the sustain, the opened and closed envelope would gradually attenuate over a substantial interval after key release.

The output signal from the PK tone source signal generator and keyer 100 is applied to a tone color filter 111 so as to form tone colors of a bass 16', a bass 8' and a bass guitar. In the same manner as the UK generator 20 described above, the musical tone signal produced by the tone color filter 111 is applied to a selector 113 parallelly through mixer 112A through 112E for different musical composition fashions. The selector 113 selects a musical tone signal having a tone color corresponding to a specific musical composition fashion designated by the musical composition designating signal $TS_2$ and sends out the selected musical tone signal as a musical tone signal PS.

The detail of the musical composition fashion designating circuit 50 will now be described with reference to FIG. 4. A UK musical composition fashion selector 120 is provided with an organo fashion selection switch $S_{11}$, a jazz fashion selection switch $S_{12}$, a mood I musical composition fashion selection switch $S_{13}$, a mood II musical composition fashion selection switch $S_{14}$ and a piano fashion selection switch $S_{15}$ which are of the self-resetting push buttom switch type and constitute a melody musical component fashion selection switch, T type flip-flop circuits $F_{11}$, $F_{12}$, $F_{13}$, $F_{14}$ and $F_{15}$ with their trigger input terminals T supplied with the state signals of the musical composition fashion selection switches $S_{11}$ through $S_{15}$, and OR gate circuits $O_{11}$, $O_{12}$, $O_{13}$, $O_{14}$ and $O_{15}$ respectively supplying reset signals to the reset input terminals of the flip-flop circuits $F_{11}$ through $F_{15}$. Each OR gate circuit is supplied with a musical composition fashion selection switch state signal other than those applied to a flip-flop circuit associated therewith. For this reason, the flip-flop circuits $F_{11}$ through $F_{15}$ do not respond when more than one of the musical composition fashion selection switches $S_{11}$ through $S_{15}$ are closed simultaneously, but when one of the switches $S_{11}$ through $S_{15}$ is closed, the flip-flop circuits respond to produce a musical composition selection signal corresponding to the closed switch. More particularly, when the organ fashion selection switch $S_{11}$, for example, is closed the Q output of the flip-flop circuit $F_{11}$ becomes "1" to designate selection of the organ fashion, whereas the other flip-flop circuit $F_{12}$ through $F_{15}$ are reset by the output signals of the OR gate circuits $O_{12}$ through $O_{15}$ inputted with the state signal of the switch $S_{11}$. At this time, the flip-flop circuit $F_{11}$ continues to maintain its states in which the Q output is "1" even when the switch $S_{11}$ is reset. Then when the switch $S_{15}$ is closed to select the piano music fashion, the Q output of the flip-flop circuit $F_{15}$ becomes "0" to designate the selection of the piano fashion while at the same time other flip-flop circuits including the flip-flop circuit $F_{11}$ are reset. In this manner, each time one musical composition fashion selection switch is closed, the UK musical composition fashion selector 120 causes a corresponding flip-flop circuit to produce a musical composition fashion selection signal.

An NOR gate circuit $NG_1$ and an OR gate circuit $OG_{11}$ provided on the output side of the musical composition fashion selector 120 constitute an initial state setting circuit which enables selection of a specific musical composition fashion when any one of the musical composition fashion selection switches is not closed. To the OR gate circuit $OG_{11}$ are inputted an organ fashion selection signal from the flip-flop circuit $F_{11}$ and the output signal of the NOR gate circuit $NG_1$, and to the NOR gate circuit $NG_1$ are inputted musical composition fashion selection signals from the flip-flop circuits $F_{12}$ through $F_{15}$. For this reason, when any one of the musical composition fashion selection switches is not closed, the output of the NOR gate circuit $NG_1$ becomes "1", while the outpout of the OR gate circuit $OG_{11}$ becomes "1" thus producing a signal designating the selection of the organ music fashion.

The musical composition fashion selection signals produced by the OR gate circuit $O_{11}$ and the flip-flop circuits $F_{12}$ through $F_{15}$ in a manner described above constitute a UK musical composition fashion designating signal $TS_1$ which is applied to the UK tone generator 20, a musical composition fashion display device 120D and a control data memory device 121.

The melody musical composition fashion display device 120D operates to selectively light melody musical fashion display lamps respectively disposed at respective push buttons of the UK musical composition fashion selection switches $S_{11}$ through $S_{15}$, whereby each time when the Uk musical composition fashion designating signal $TS_1$ designates a specific musical composition fashion a melody musical composition fashion display lamp of a musical composition fashion selection switch corresponding to that musical composition fashion is lighted.

An LK·PK musical composition fashion selector 122 is constructed and operates similar to the UK musical fashion selector 120 except that there are provided OR gate circuits $OG_1$ through $OG_5$ that compute the logical sum of the state signals of the UK musical composition fashion selection switches and the state signals of the LK·PK musical composition fashion selection switches $S_{21}$ through $S_{25}$. Switches $S_{21}$ through $S_{25}$ constitute an accompaniment musical composition fashion selection switch 52 and respectively act as an organ fashion selection switch, a jazz fashion selection switch, a mood I fashion selection switch, a mood II fashion selection switch, and a piano fashion selection switch. T-type flip-flop circuits $F_{21}$ through $F_{25}$ are provided to form a musical composition fashion selection signal according to the OR gate circuits $OG_1$ through $OG_5$, and OR gate circuits $O_{21}$ through $O_{25}$ are provided to form signals for resetting the flip-flop circuits $F_{21}$ through $F_{25}$. An OR gate circuit $OG_{21}$, and an NOR gate circuit $NG_2$ provided on the output side of the musical composition fashion selection 122 respectively correspond to the OR gate circuit $OG_{11}$ and the NOR gate circuit $NG_1$ described above and constitute an initial state setting circuit designating an organ fashion when all outputs of the OR gate circuits $OG_1$ through $OG_5$ are "0".

The musical composition fashion selection signal produced by the OR gate circuit $OG_{21}$ and the flip-flop circuits $F_{22}$ through $F_{25}$ comprises an LK·PK musical composition fashion designating signal $TS_2$ applied to the PK tone generator 30 and the PK tone generator 40 described above and also to an accompaniment musical composition fashion display device 122D and the control data memory device 121.

The accompaniment musical composition fashion display device 122D operates to selectively light accompaniment musical composition fashion display lamps respectively located at the push buttons of the musical composition fashion selection switches $S_{21}$ through $S_{25}$ so as to light an accompaniment musical composition fashion display lamp of a musical composition fashion selection switch corresponding to a musical composition fashion designated by the LK·PK musical composition fashion designating signal $TS_2$.

The control data memory device comprises a read only memory device (ROM) storing 5 sets of control data concerning tremolo, tone volume, sustain, vibrato and slow attack for different musical composition fashions. One example of the content of the ROM is shown in the following table.

TABLE

| | | Musical Composition fashion | | | | |
|---|---|---|---|---|---|---|
| Control data | | Organ | Jazz | Mood I | Mood II | Piano |
| Tremolo | UK portion (U) | 0 | 0 | | 0 | |
| | LK portion (L) | 0 | 0 | | 0 | |
| | fast | | 0 | | | |
| Tone volume | UK portion (U) | | 0 | 0 | 0 | 0 |
| | LK portion (L) | | | | | |
| | PK portion (P) | | | | | |
| Sustain | UK portion (U), major | | | | | |
| | UK portion (U), minor | 0 | | 0 | | |
| | PK portion (P) | 0 | | 0 | 0 | |
| Vibrato | Slow start | | | 0 | | |
| | Fast start | | | | | |
| Slow attack | | 0 | | 0 | 0 | |

In this Table, symbols 0 means that tremolo, sustain, vibrato or slow attack is set and that a large tone volume is set, while blanks mean that tremolo, sustain, vibrato or slow attack is not set and that a small tone volume is set. Further, 0 corresponds to a signal "1", and a blank to a signal "0". These memory contents are sequentially read out for each musical composition fashion in response to the UK musical composition fashion designating signal $TS_1$ and the LK·PK musical composition fashion designating signal $TS_2$, a musical composition fashion designating signal $TS_3$ constituted by the read memory contents.

By combining the musical composition fashion designating signals $TS_1$, $TS_2$ and $TS_3$ generated in the manner described above a musical composition fashion designating signal TS is obtained that designates the overall musical composition fashion of the melody performance portion and the accompaniment portion of the musical instrument, the signal TS being distributed among respective parts to control the musical instrument as has been described in connection with FIG. 1.

With the musical fashion composition designating circuit shown in FIG. 4, it is possible to simultaneously designate the melody musical composition fashion and the accompaniment musical composition fashion by the UK musical composition fashion selection switches $S_{11}$ through $S_{15}$, and if desired, it is possible to change only the accompaniment musical composition fashion with the LK·PK musical composition fashion selection switches $S_{21}$ through $S_{25}$ which is advantageous for the musical tone effect. More particularly, at the initial state, when the organ fashion is preferentially designated for both the melody performance portion and the accompaniment portion and then when the UK musical composition fashion selection switch $S_{15}$, for example is closed, both the melody performance portion and the accompaniment portion are switched to the piano fashion from the organ fashion, because the state signal of the switch $S_{15}$ sets both flip-flop circuits $F_{15}$ and $F_{25}$. Then, upon closing of the musical composition fashion selection switch $S_{25}$, for example, the flip-flop circuit $F_{25}$ is reset, while the flip-flop circuit $F_{23}$ is set so that the musical composition fashion designating signal $TS_2$ would designate the mood I musical composition fashion. Under these states, at the melody performance portion, the piano fashion is continuously designated, whereas at the accompaniment portion, the mood I fashion would be newly designated. Accordingly, different musical composition fashions are designated for the melody performance portion and the accompaniment portion, thus enabling to enjoy performances rich in variety.

Figure 5A:
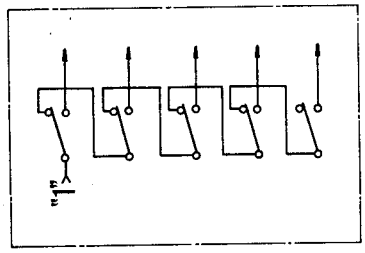
Figure 5:
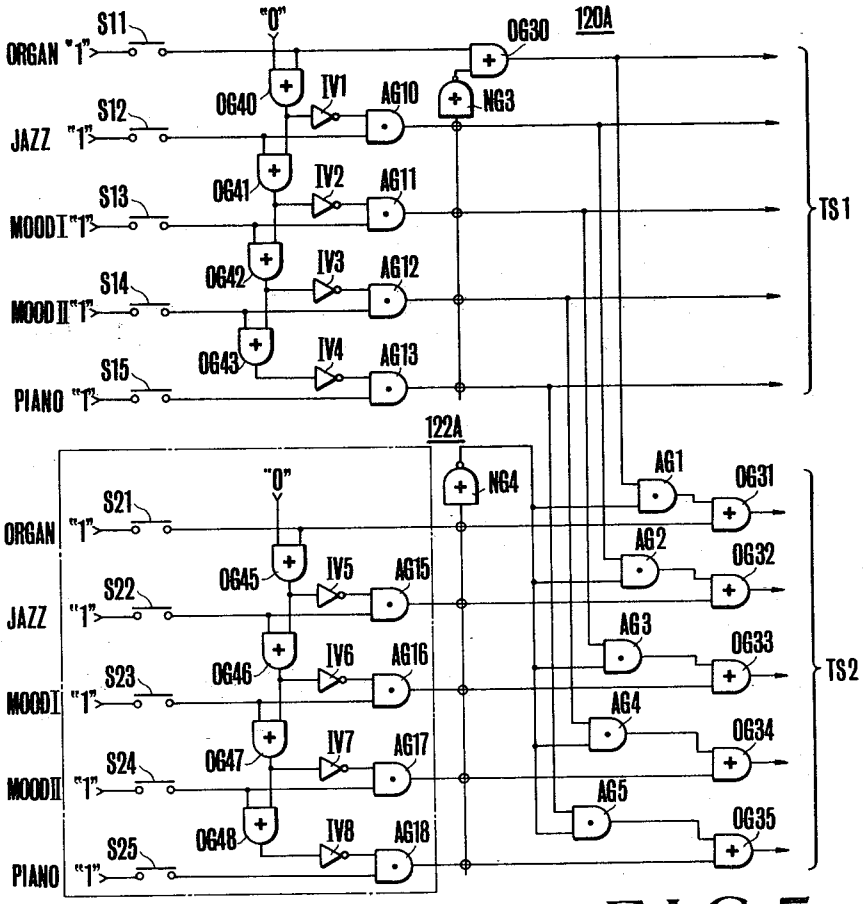
Figure 6:
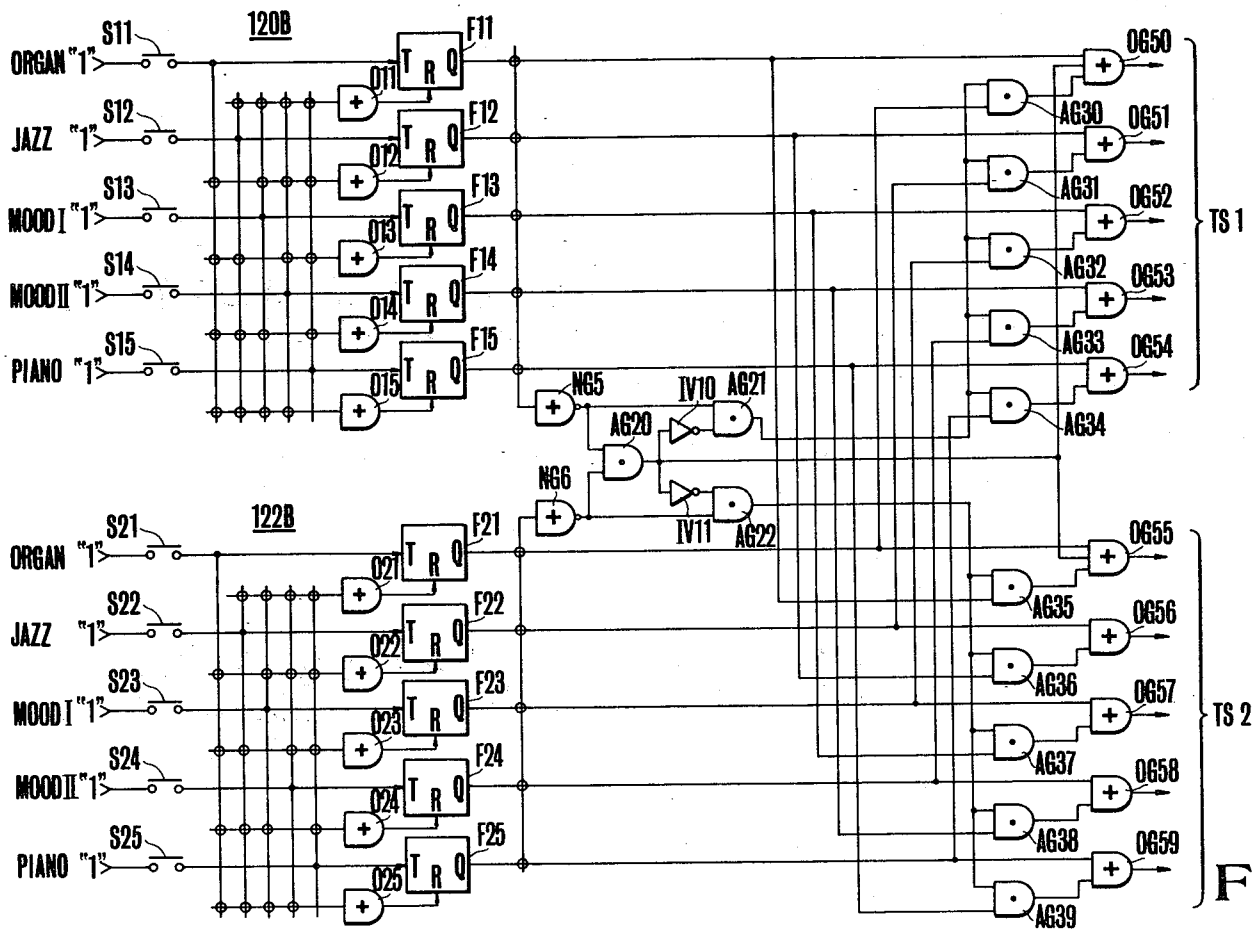

FIGS. 5 and 6 are connection diagrams showing modifications of the musical composition fashion designating circuit shown in FIG. 4. In the musical composition designating circuit shown in FIG. 5, a UK musical composition fashion selector 120A and an LK musical composition fashion selector 122A respectively include selection switches $S_{11}$ through $S_{15}$ and $S_{21}$ through $S_{25}$ for an organ fashion, a jazz fashion, a mood I fashion, a mood II fashion and a piano fashion. In the selector 120A when any one of the musical composition fashion selection switches $S_{11}$ through $S_{15}$ is not closed, an NOR gate circuit $NG_3$ produces an output "1", so the OR gate circuit $OG_{30}$ produces an output "1". Naturally, all of the AND gate circuits $AG_{10}$ through $AG_{13}$ produces an output "0". The UK musical composition fashion designating signal $TS_1$ comprises the outputs of the OR gate circuit $OG_{30}$ and the AND gate circuits $AG_{10}$ through $AG_{13}$ is supplied to a succeeding stage, for example, the control data memory device 121 shown in FIG. 4 to designate a musical composition fashion of the melody performance portion.

In the selector 122A, when any one of the musical composition fashion selection switches $S_{21}$ through $S_{25}$ is not closed, this state is detected by an NOR gate circuit $NG_4$, so NOR gate circuit $NG_4$ produces an output signal "1" to send out the musical composition fashion designating signal $TS_1$ via AND gate circuits $AG_1$ through $AG_5$ and OR gate circuits $OG_{31}$ through $OR_{35}$, which respectively correspond to the selection switches $S_{11}$ through $S_{15}$ for the melody performance. Thus, the musical composition fashion designating signal $TS_2$ would not be produced so long as the musical composition fashion designating signal $TS_1$ is not sent out. By the way, in the selector 120A, when any one of the selection switches $S_{11}$ through $S_{15}$ is not closed, an organ fashion designating signal is sent out via the AND gate circuit $AG_1$ and the OR gate circuit $OG_{31}$.

In the selector 120A, the organ, jazz, mood I, mood II and piano are selected according to the order of priority described above. Such priority selection is made by OR gate circuits $OG_{40}$ through $OG_{43}$, inverters $IV_1$ through $IV_4$ and AND gate circuits $AG_{10}$ through $AG_{13}$. For example, when the organ fashion designating switch $S_{11}$ is closed, an output "1" of the OR gate circuit $OG_{40}$ is sent to the inverter $IV_1$, the inverter $IV_2$ via the OR gate circuit $OG_{41}$, the inverter $IV_3$ via the OR gate circuit $OG_{42}$ and the inverter $IV_4$ via the OR gate circuit $OG_{43}$ and one of the inputs of each of the AND gate circuits $AG_{10}$ through $AG_{13}$ is changed to "0". This prevents simultaneous selection of a plurality of musical composition fashions caused by the closure of other switches.

For the selector 122A too, a similar priority selection circuit is constituted by OR gate circuits $OG_{45}$ through $OG_{48}$, inverters $IV_5$ through $IV_8$ and AND gate circuits $AG_{15}$ through $AG_{18}$.

FIG. 5A shows a modification of the priority selection circuit bounded by dotted lines in FIG. 5 in which contact type selection switches are used. Thus, the contacts of these switches are suitably connected to form the priority selection circuit with hardwares.

FIG. 6 shows still another modification of the musical composition fashion selector which is constructed such that when either one of the melody fashion and the accompaniment fashion is designated, the other is also automatically designated.

A priority selection circuit constituted by OR gate circuits $O_{11}$ through $O_{15}$, $O_{21}$ through $O_{25}$ and flip-flop circuits $F_{21}$ through $F_{25}$, so musical composition fashion selectors 120B and 122B have the same construction as that shown in FIG. 4. In this case, the flip-flop circuits $F_{11}$ through $F_{15}$ and $F_{21}$ through $F_{25}$ are not only of the T-type but also may be of the RS-type. When any one of the musical composition fashion selection switches $S_{11}$ through $S_{15}$ and $S_{21}$ through $S_{25}$ is not operated, the outputs of the NOR gate circuits $NG_5$ and $NG_6$ become "1", whereas the output of the AND gate circuit $AG_{20}$ becomes "1" with the result that the OR gate circuit $OG_{50}$ for designating the melody musical composition fashion of an organ and the OR gate circuit $OG_{55}$ for designating the accompaniment musical composition fashion of an organ produce output "1". When only one of the UK musical composition fashion selection switches $S_{11}$ through $S_{15}$ is operated, the output of the NOR gate circuit $NG_6$ is "1" and that of the NOR gate circuit $NG_5$ is "0" so that the output of the AND gate circuit $AG_{20}$ is "0" whereby the inverters $IV_{10}$ and $IV_{11}$ apply their outputs "1" to one inputs of AND gate circuits $AG_{21}$ and $AG_{22}$. Accordingly, the AND gate circuit $AG_{22}$ supplies its "1" output to one inputs of AND gate circuits $AG_{35}$ through $AG_{39}$, the other inputs thereof being supplied with a state signal from a corresponding melody musical composition fashion selection switch. Accordingly, only one AND gate circuit corresponding to the selected melody musical composition fashion sends its output to a corresponding one of the OR gate circuits $OG_{55}$ through $OG_{59}$. As above described upon selection of melody musical composition fashion, an accompaniment musical composition fashion corresponding thereto would be automatically designated.

When only one of accompaniment musical fashion selection switch $S_{21}$ through $S_{25}$ is operated, the output of the NOR gate circuit $NG_6$ becomes "0", whereas that of the AND gate circuit $NG_5$ becomes "1". Consequently, the AND gate circuit $AG_{21}$ applies its "1" output to one inputs of the NAD gate circuits $AG_{30}$ through $AG_{34}$, the other inputs thereof being supplied with a signal from a corresponding accompaniment musical composition fashion selection switch. For this reason, only the output of an AND gate circuit corresponding to the selected accompaniment musical fashion is sent to a corresponding one of the OR gate circuits $OG_{50}$ through $OR_{54}$. Thus, where an accompaniment musical composition fashion is designated, a melody musical composition fashion corresponding thereto would also be designated.

Although in the foregoing embodiments, musical composition fashion selection switches were provided respectively for the UK portion and the LK·PK portion, it is also possible to provide musical composition fashion selection switches for each of the UK, LK and PK portions so as to permit the musical composition fashion designation of the LK and PK portions with the musical composition fashion selection switch of the UK portion and to permit the musical composition fashion designation of the PK portion with the musical composition fashion selection switch of the LK portion.

Instead of designating the musical composition fashion of the LK·PK portion with the musical composition fashion selection switch of the UK portion, the latter selection switch may be used to designate the musical composition fashion of the LK·PK portion.

It should be understood that the invention is not limited to the specific embodiments described above and that many changes and modifications will be obvious to one skilled in the art. Thus, for example, although in the foregoing embodiments, self-returning switches were used as the selection switches, any one of well known switches can be used. For instance, push-on/push-off type switches or self-luminous switches containing lamps may be used.

As above described, since the electronic musical instrument embodying the invention is constructed such that a melody musical composition fashion or an accompaniment musical composition fashion can readily be set with a melody musical composition fashion selection switch or an accompaniment musical composition fashion selection switch, it is simple to enjoy a performance of a desired musical composition fashion. This is particularly advantageous for a beginner in that the time and labor for setting the musical tone having the desired musical composition fashion before the performance can be greatly reduced. Moreover, even when either one of the melody musical composition fashion selection switches and the accompaniment musical composition fashion selection switch is not operated, the operation of the other simultaneously designates the musical composition fashions of the melody performance portion and the accompaniment portion, thus greatly simplifying the musical composition fashion designating operation. Moreover, as it is possible to designate different musical composition fashions for the melody performance portion and the accompaniment portion it is possible to impart variations to the performance thus alleviating a monotonic feeling.

What is claimed is:

1. An electronic musical instrument comprising:

a first keyboard having a plurality of keys for performing a melody;

a second keyboard having a plurality of keys for performing an accompaniment;

a melody tone generator generating a melody tone in response to depression of a key of said melody performance keyboard;

an accompaniment tone generator generating an accompaniment tone in response to depression of a key of said accompaniment performance keyboard;

a plurality of melody musical composition fashion selection switches connected to a like plurality of first logic circuit means for designating a single one of a musical composition fashion of a melody tone to be produced from among a plurality of predetermined kinds of musical composition fashions for melody;

a plurality of accompaniment musical composition fashion selection switches connected to a like plurality of second logic circuit means for designating a single one of a musical composition fashion of an accompaniment tone to be produced from among a plurality of predetermined kinds of musical composition fashions for accompaniment;

said second logic circuit means being connected to said first logic circuit means such that the musical composition fashion of an accompaniment tone is selected in correspondence with the selected musical composition fashion of a melody tone when none of said plurality of accompaniment musical composition fashion selection switches are operated, and such that the musical composition fashion of a melody tone is selected in correspondence with the selected musical composition fashion of an accompaniment tone when none of said plurality of melody musical composition fashion selection switches are operated;

a modifying parameter generator which generates a modifying parameter corresponding to an operated one of said musical composition fashion selection switches;

modifying means for modifying outputs of said melody and accompaniment tone generators in accordance with said modifying parameter generated from said modifying parameter generator; and means for producing a musical tone signal in accordance with said output of said modifying means.

2. An electronic musical instrument according to claim 1 wherein said second keyboard comprises a chord keyboard suitable for performing a chord as said accompaniment.

3. An electronic musical instrument according to claim 1 wherein said second keyboard comprises a bass keyboard suitable for performing a bass as said accompaniment.

4. An electronic musical instrument according to claim 1 wherein said modifying parameter generator generates a parameter that varies an oscillation frequency of outputs of said melody tone generator and said accompaniment tone generator.

5. An electronic musical instrument according to claim 1 wherein said modifying means further includes:

a control circuit, which when either one of said melody musical composition fashion selection switch and said accompaniment musical composition fashion selection switch is operated, causes the other selection switch to generate a selection signal;

said control circuit generating a selection signal for a switch operated prior to said operation when the other selection switch is operated.

6. An electronic musical instrument according to claim 1 wherein said modifying parameter generating means further comprises:

control data memory means for storing a third musical composition designating signal and for generating said third designating signal in accordance with said melody and accompaniment designating signals;

and means for combining said first, second and third musical composition designating signals into said modifying parameter which is applied to said melody tone generator and said accompaniment tone generator.

7. An electronic musical instrument according to claim 1 wherein said modifying parameter generator includes a third logic circuit means comprising means for generating, when one of said melody musical composition fashion selection switches is operated, melody and accompaniment selection signals corresponding to the operated melody musical composition fashion selection switch, and means for generating, when an accompaniment musical composition fashion selection switch is operated, an accompaniment selection signal, as a substitution of the accompaniment portion of said melody and accompaniment selection signals, corresponding to the operated accompaniment musical composition selection switch and means for generating said modifying parameters by using said selection signals.

8. An electronic musical instrument according to claim 1 wherein said modifying parameter generator includes:

a third logic circuit means comprising means for generating, when one of said accompaniment musical composition fashion selection switches is operated, melody and accompaniment selection signals corresponding to the operated accompaniment composition fashion selection switch, and means for generating, when a melody musical composition fashion selection switch is operated, a melody selection signal, as a substitution of the melody portion of said melody and accompaniment selection signals, corresponding to an operated melody musical composition fashion selection switch; and means for generating said modifying parameter by using said selection signals.

9. An electronic musical instrument according to claim 7 or claim 8 wherein said third logic circuit means comprises a first logic circuit for generating said melody musical composition fashion designating signal;

and a second logic circuit for generating said accompaniment musical composition fashion designating signal.

10. An electronic accompaniment and melody musical instrument according to claim 7 or claim 8 wherein said musical composition fashion selection switches and said third logic circuit means are constituted by a plurality of single pole double throw selection switches, and means for connecting a stationary contact of a preceding selection switch to a movable contact of a succeeding selection switch.

11. An electronic musical instrument according to claim 9 wherein said third logic circuit means comprises:

first and second logic circuits respectively including OR gate circuits and flip-flop circuits operated by said selection switches;

third and fourth logic circuits respectively including AND gate circuits and OR gate circuits, one input of said OR gate circuits being respectively connected to outputs of said AND gate circuits and the other inputs being supplied with outputs of said flip-flop circuits of said first and second logic circuits, an AND gate circuit ($AG_{20}$) with inputs connected to receive outputs of said flip-flop circuits of said first and second logic circuits respectively via NOR gate circuits;

a pair of AND gate circuits with one input connected to receive outputs of said NOR gate circuits respectively and the other inputs connected to receive an output of said AND gate circuit ($AG_{20}$) via inverters respectively; and means for applying outputs of said pair of AND gate circuits to the other inputs of the AND gate circuits of said third and fourth logic circuits thus causing them to produce first and second tone designating signals.

12. On electronic musical instrument according to claim 1 wherein each said melody composition fashion selection switches are of the self-returning type.

13. An electronic musical instrument according to claim 1 wherein said modifying means comprises:

a plurality of filters connected to receive the outputs of respective tone generators for imparting different tone color to said outputs;

a plurality of mixers for selectively admixing outputs of said filters; and a selector for selecting outputs of said mixers in accordance with a selected musical composition fashion.

14. An electronic musical instrument according to claim 1 wherein said modifying means further comprises a tremolo effect circuit.

15. An electronic musical instrument according to claim 1 wherein the output of said modifying parameter generator comprises a melody musical composition fashion designating signal, an accompaniment musical component designating signal and a signal that designates characteristics of a tremolo, a tone volume, a sustain, and a vibrato.

16. An electronic musical instrument according to claim 1 which further comprises display means for displaying a selected musical composition fashion.

17. An electronic musical instrument according to claim 1 wherein said second keyboard for performing an accompaniment comprises keyboards for respectively performing a chord and a bass.

18. An electronic musical instrument according to claim 1 wherein said modifying means comprises an expression device which controls tone volume of the produced musical tone according to a degree of depression of a pedal.

* * * * *

UNITED STATES PATENT AND TRADEMARK OFFICE

CERTIFICATE OF CORRECTION

PATENT NO. : 4,391,176

DATED : 7/5/83

INVENTOR(S) : Naoyuki Niinomi; Kunihiko Watanabe

It is certified that error appears in the above-identified patent and that said Letters Patent is hereby corrected as shown below:

| COLUMN | LINE | DESCRIPTION |
|---|---|---|
| 13 | 65 | Delete "An electronic accompaniment and melody musical", insert --An electronic musical--. |
| 13 | 67 | Delete "said musical", insert --said accompaniment and melody musical--. |
| 14 | 32 | Delete "On", insert --An--. |

Signed and Sealed this

*Twelfth* Day of *March 1985*

[SEAL]

*Attest:*

DONALD J. QUIGG

*Attesting Officer* *Acting Commissioner of Patents and Trademarks*